US006208072B1

(12) United States Patent
Watanabe et al.

(10) Patent No.: US 6,208,072 B1
(45) Date of Patent: Mar. 27, 2001

(54) IMAGE DISPLAY APPARATUS WITH FOCUSING AND DEFLECTING ELECTRODES

(75) Inventors: Michiaki Watanabe; Mitsunori Yokomakura; Makoto Kawachi; Kenji Fujishiro; Kanji Imai, all of Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/134,225

(22) Filed: Aug. 14, 1998

(30) Foreign Application Priority Data

Aug. 28, 1997 (JP) ..... 9-232886

(51) Int. Cl.[7] ..... H01J 1/62
(52) U.S. Cl. ..... 313/497; 313/422
(58) Field of Search ..... 313/495, 496, 313/497, 422; 315/169.3

(56) References Cited

U.S. PATENT DOCUMENTS

| | | | | |
|---|---|---|---|---|
| 4,145,633 | | 3/1979 | Peters | 313/422 |
| 4,404,493 | * | 9/1983 | Nonmura et al. | 313/422 |
| 4,672,272 | * | 6/1987 | Littwin | 313/422 |
| 4,891,552 | | 1/1990 | Moriyama et al. | 313/495 |
| 4,900,981 | | 2/1990 | Yamazaki | 313/422 |
| 4,908,539 | | 3/1990 | Meyer | 315/169.3 |
| 5,504,387 | | 4/1996 | Hamagishi | 313/310 |
| 5,652,083 | | 7/1997 | Kumar et al. | 430/315 |

FOREIGN PATENT DOCUMENTS

| | | | |
|---|---|---|---|
| 0 172 089 | 2/1986 | (EP) | H01J/31/12 |
| 0 312 007 | 4/1989 | (EP) | H01J/31/12 |
| 0 316 871 A2 | 5/1989 | (EP) | H01J/31/12 |
| 0 404 022 | 12/1990 | (EP) | H01J/31/12 |
| 0 572 777 | 12/1993 | (EP) | H01J/31/12 |
| 0 614 209 | 9/1994 | (EP) | H01J/31/12 |
| 0 628 982 | 12/1994 | (EP) | H01J/31/12 |
| 739 029 | 10/1996 | (EP) | H01J/31/12 |
| 53-38260 | 4/1978 | (JP) | H01J/31/12 |
| 53-74357 | 7/1978 | (JP) | H01J/31/12 |
| 2-61946 | 3/1990 | (JP) | H01J/31/12 |
| 3-149728 | 6/1991 | (JP) | H01J/31/12 |
| 8-236044 | 9/1996 | (JP) | H01J/31/12 |
| 96/30926 | 10/1996 | (WO) | H01J/31/12 |
| 97/15912 | 5/1997 | (WO) | G09G/3/22 |

OTHER PUBLICATIONS

Nov. 13, 1998, Communication from European Patent Office and attached Search Report.

* cited by examiner

*Primary Examiner*—Michael H. Day
(74) *Attorney, Agent, or Firm*—Merchant & Gould P.C.

(57) ABSTRACT

An image display apparatus includes a vacuum container whose inside is kept under vacuum, a fluorescent layer, an electron emission source having an electron source which is arranged in a matrix and electrodes having a function for focusing and deflecting electron beams, and the fluorescent layer is illuminated by the electron beam. The average electric field strength between the fluorescent layer and the electrodes is set to be stronger than that between the electrodes and the electron emission source. Consequently, electron beams can be deflected in predetermined directions, and electron beams that land on the fluorescent layer can be focused to be a predetermined size. As a result, electron beams can be landed exactly at predetermined positions of the fluorescent layer having an arrangement whose number is more than the number of the electron emission source, and an image display apparatus having high resolution can be provided.

11 Claims, 9 Drawing Sheets

IMAGE DISPLAY APPARATUS WITH FOCUSING AND DEFLECTING ELECTRODES

FIELD OF THE INVENTION

The present invention relates to an image display apparatus, and more particularly relates to a thin image display apparatus used for a video camera and the like.

BACKGROUND OF THE INVENTION

Conventionally, a cathode ray tube has been used mainly as an image display apparatus for color television, personal computer and the like. However, in recent years, an image display apparatus has been required to be miniaturized, lightened and thinner. In order to satisfy these demands, various types of thin image display apparatus have been developed and commercialized.

Under these circumstances, various types of thin image display apparatus have been researched and developed recently. In particular, a liquid crystal display and a plasma display have been developed actively. The liquid crystal display has been applied to various types of products such as a portable computer, a portable television, a video camera, a car-navigation system and the like. In addition to that, the plasma display has been applied to a product such as a large-scale display, for example, 20 inch-display or 40-inch display.

However, there are the following problems for the liquid crystal display and the plasma display. The liquid crystal display has a narrow visual angle and a slow response. Regarding the plasma display, high brightness can't be obtained and the consumed electricity is large.

Then, an image display apparatus (hereinafter referred to as "a field emission display", or "a display") to which field emission, that is, a phenomenon in which electrons are emitted in a vacuum at room temperature, is applied, has attracted considerable attention. The field emission display is a spontaneous luminescent type, therefore it is possible to obtain a wide visual angle and high brightness. Further, its basic principle (to illuminate a fluorescent substance with electron beams) is same as that of a conventional cathode ray tube, and therefore a picture with natural color and high reproduction can be displayed.

The above-mentioned type of field emission display is disclosed in Japanese Laid Open Patent No. (Tokkai-Sho) 61-221783, Japanese Laid Open Patent No. (Tokkai-Hei) 1-100842, and Japanese Laid Open Patent No. (Tokkai-Hei) 2-61946.

FIG. 7 is a cross-sectional view showing schematic structure of a first conventional field emission display (refer to Japanese Laid Open Patent No. (Tokkai-Sho) 61-221783). As shown in FIG. 7, the conventional field emission display comprises an electron emission source 21, a transparent flat substrate 24, a fluorescent layer 23 and a conductive thin film 25. The fluorescent layer 23 and the conductive thin film 25 are layered sequentially on the inner surface of the transparent flat substrate 24 and face the electron emission source 21. The cathode (electron emission source) 21 comprises a plurality of conductive micro-points 21*a* formed on the surface of a conductive coating material 21*b* and the conductive coating material 21*b* is layered on the surface of an insulating substrate 21*c*. Each conductive micro-point 21*a* is separated by an insulating coating material 21*d*. A grid 21*e*, in which a hole is provided at the position corresponding to each conductive micro-point 21*a*, is provided on the insulating coating material 21*d*.

According to the above-mentioned field emission display, conductive micro-points 21*a* emit electrons to excite the fluorescent layer 23. The excited fluorescent layer 23 emits a light and the light is observed through a transparent flat substrate 24. According to the conventional technique, it is required to form 20,000 to 30,000 pieces of conductive micro-points 21*a* per square-millimeter and electrons (electron beams) are emitted from a plurality of conductive micro-points 21*a* to illuminate one pixel.

FIG. 8 is a cross-sectional view showing schematic structure of a second conventional field emission display (refer to Japanese Laid Open Patent No. (Tokkai-Hei) 2-61946). As shown in FIG. 8, the conventional field emission display comprises an electron emission source 31, a fluorescent layer 33*a*, 33*b* and 33*c*, a transparent flat substrate 34, and a conductive thin film 35*a*, 35*b* and 35*c*. The fluorescent layers, 33*a*, 33*b* and 33*c*, and the conductive thin films 35*a*, 35*b* and 35*c* are layered sequentially on the inner surface of the transparent flat substrate 34 and face the electron emission source 31. The electron emission source 31 comprises a plurality of conductive micro-points 31*a* formed on a conductive coating material 31*b*, and the conductive coating material 31*b* is layered on the surface of an insulating substrate 31*c*. Each conductive micro-point 31*a* is separated by an insulating coating material 31*d*. A grid 31*e* is provided on the insulating coating material 31*d*.

According to the above-mentioned field emission display, electrons which are emitted from a plurality of conductive micro-points 31*a* can be landed at intended components of the fluorescent layer (in FIG. 8, a fluorescent layer 33*a*) by controlling a potential which is applied to the conductive thin films 35.

FIG. 9 is a cross-sectional view showing schematic structure of a third conventional field emission display (refer to Japanese Laid Open Patent No. (Tokkai-Hei) 1-100842). As shown in FIG. 9, the conventional field emission display comprises an electron emission source 41, a fluorescent layer 43*a* and 43*b*, a faceplate 44 and a transparent electrode 45. The fluorescent layers 43*a* and 43*b* are provided on the faceplate 44 via the transparent electrode 45. The electron emission source 41 faces the fluorescent layers 43*a* and 43*b*. The electron emission source 41 comprises a substrate 41*e*, a thin film 41*c* formed on the substrate 41*e* and electrodes 41*a* and 41*b* which are provided for applying a voltage to the thin film 41*c*. An electron emission part 41*d* is provided by processing the thin film 41*c*.

According to the above-mentioned field emission display, the deflection of electron beams emitted from the electron emission part 41*d* is controlled by controlling a voltage applied to electrodes 41*a* and 41*b*, and the deflected electron beam excites a fluorescent layer 43*a* or 43*b*, and the fluorescent layer 43*a* or 43*b* is illuminated. Further, in the conventional field emission display, a technology such that electron beams are focused on the surface of the fluorescent layer by providing a flat electrode (not shown in FIG. 9) between the electron emission source 41 and the fluorescent layer 43 and applying a voltage lower than that of a transparent electrode 45 to the flat electrode, is used, that is, the technology such that the electron beams are focused on the surface of the fluorescent layer by utilizing the lens effect, is used.

However, the conventional field emission display shown in FIG. 7 has following problems. Electrons which are emitted from a conductive micro-point 21*a* are very weak, therefore a fluorescent layer 23 and an electron emission source 21 are required to face each other very closely.

Further, it is required that one pixel of fluorescent substance is illuminated by electrons which are emitted from a plurality of conductive micro-points 21*a*, and therefore electron beams can't be deflected and focused. As a result, electrons which land on the fluorescent layer 23 extend, and therefore it is difficult to increase the density of the fluorescent layer 23. Consequently, a display having high resolution can't be provided.

In the conventional field emission display shown in FIG. 8, electron beams are deflected by controlling (switching) a potential which is applied to a conductive thin film 35. In order to switch the conducive thin film 35, it is required that a switching scan be performed under a high voltage. However, it is very difficult to realize a circuit element in which a high voltage of kilo volt order applied to the conductive thin film 35 can be switched at a high frequency in an image display. Consequently, according to the conventional technology, a display having high resolution can't be provided.

In the conventional field emission display shown in FIG. 9, the electron beams are deflected and focused. However, in the conventional field emission display, a current is passed between two electrodes 41*a* and 41*b* to generate electrons, and the character, such that emitted electron beams are always deflected by the potential difference between electrodes, is used. Consequently, the potential difference between these two electrodes 41*a* and 41*b* is required to be a predetermined value to emit electron beams. Therefore the direction of deflection can be changed but a desirable voltage to control the grade of the deflection can't be applied. Regarding focusing of electron beams, the electron beams are focused by controlling a voltage which is applied to a flat electrode. However, the flat electrode has only one function for changing the direction of electron beams that are emitted with a certain angle to predetermined directions. Consequently, according to the conventional field emission display, scanning deflection, that is, where an angle of electron beams are changed appropriately for the electron beams to land on a plurality of pixels of the fluorescent substance sequentially, can't be performed.

Further, in the conventional field emission displays shown in FIGS. 7, 8 and 9, if a deviation of position between an electron emission source 21, 31 and 41, and a fluorescent layer 23, 33 and 43, respectively, (a deviation of position caused by manufacturing error or assembling error of each material and the like) is caused, there is no function for adjusting the deviation of position. Consequently, electron beams can't be prevented from irradiating a fluorescent substance other than a desired fluorescent substance. As a result, it is required to have a predetermined tolerance in designing a fluorescent pixel and an electron emission source, and therefore it is difficult to provide a display having high resolution.

SUMMARY OF THE INVENTION

In order to solve the above-mentioned problems, this invention provides a display having high resolution, which comprises electrodes having a function for deflecting and focusing electron beams emitted from an electron emission source having an electron source, wherein a deviation of position between the electron emission source and a fluorescent layer which is generated in assembling a display can be compensated.

In order to achieve the above-mentioned purpose, a display of this invention comprises, in a vacuum container whose inside is kept under vacuum, a fluorescent layer, an electron emission source having an electron source and electrodes having a function for focusing and deflecting for scanning electron beams emitted from the electron emission source. The electrodes are arranged between the fluorescent layer and the electron emission source, the average electric field strength between the fluorescent layer and the electrodes is set to be stronger than that between the electrodes and the electron emission source, and the fluorescent layer is illuminated by the electron beams.

According to the display of this invention, the electron beams pass between the electrodes and are deflected in predetermined manner. Therefore, the electron beams can be landed at predetermined positions of the fluorescent layer whose arrange pitch is narrower than that of the electron emission source. Further, the electron beams can be focused to be a predetermined size by setting the average electric filed strength between the fluorescent layer and the electrodes to be stronger than that between the electrodes and the electron emission source. Consequently, according to this invention, the electron beams can be deflected to predetermined directions and the electron beams which land on the fluorescent layer can be focused to be a predetermined size by using the electrodes having a function for focusing and deflecting the electron beams. Accordingly, the electron beams can be landed exactly at the predetermined position of the fluorescent layer having a component whose number is more than the number of the electron source. As a result, a display having high resolution can be obtained.

Further, in the display of this invention, it is preferable that the electrodes are pairs of electrodes that sandwich electron beam trajectories, and different voltages can be applied between the pairs of electrodes. According to the preferable example, the electron beams can be deflected effectively by applying different voltages between the pairs of electrodes that sandwich electron beam trajectories.

Further, it is preferable that the display of this invention has deviated position memory storing data corresponding to the deviation of landing position of the electron beams on the fluorescent layer, and a correction system for applying an off-set voltage between the pairs of electrodes to correct the deviation of the landing position of the electron beams based on the data. According to the preferable example, in assembling the display, even if there is a deviation between the actual landing position on the fluorescent layer of the electron beams and the designed landing position of the electron beams caused by assembling error or the like, the deviation can be corrected by applying the off-set voltage to the electrodes. As a result, overlap irradiation, that is, irradiation of electron beams on a plurality components of fluorescent substance at the same time, or error irradiation, that is, irradiation of electron beams on wrong components of fluorescent substance, can be prevented and a display having high resolution can be obtained.

In the preferable structure, it is preferable that the same off-set voltage is applied to all of the pairs of electrodes of the display. According to the preferable example, the same off-set voltage is applied between all electrodes. Therefore the deviation of landing position of electron beams caused by assembling error or the like can be corrected by using simple apparatus effectively and with low cost. In particular, this structure is very effective for a case in which the deviation amount of landing position of all electron beams are substantially same.

In the preferable structure of this invention, it is preferable that the landing position of each electron beam can be corrected independently by applying the off-set voltage between each pair of the electrodes independently. According to the preferable example, even if the amount of the deviation of landing position of each electron beam is not the same and has variation caused by assembling error or the like, an optimum off-set voltage can be applied independently to each pair of the electrodes corresponding to the amount of the deviation of the electron beam sandwiched by each pair of the electrodes. As a result, the deviation of landing position of the electron beams can be corrected independently and effectively.

According to the preferable structure, it is preferable that the pairs of electrodes of the display are divided into a plurality of blocks, and landing positions of the electron beams can be corrected independently for each block of the pairs of electrodes by applying the off-set voltage to each block of the pairs of electrodes. According to the preferable structure, the deviation of landing position in a certain area of display can be corrected independently corresponding to the amount of the deviation in the certain area of display. Consequently, the quality of the whole surface of a display can be improved by using a comparatively simple correction means.

Further, in a display of this invention, it is preferable that the electrodes comprise a first electrode that focuses and deflects the electron beams in the horizontal direction and a second electrode that focuses and deflects the electron beams in the vertical direction. According to the preferable example, the electron beams can be focused and deflected both in the horizontal and vertical directions. As a result, a display having high resolution can be obtained.

Further, in a display of this invention, it is preferable that the fluorescent layer is formed on the inner surface of the vacuum container. According to the preferable example, the vacuum container and the fluorescent layer are formed integrally. Therefore the production procedure can be simplified and the number of steps can be decreased.

Further, in a display of this invention, the structure of an electron source is not limited. For example, an electron source which is divided and arranged in a matrix, which is divided and arranged in stripes, or which is arranged continuously over a surface of a substrate may be used.

DETAILED DESCRIPTION OF THE PREFERRED EMBODIMENT

Hereinafter, an example of a display of this invention will be described referring to the accompanying drawings.

A First Embodiment

Figure 1:
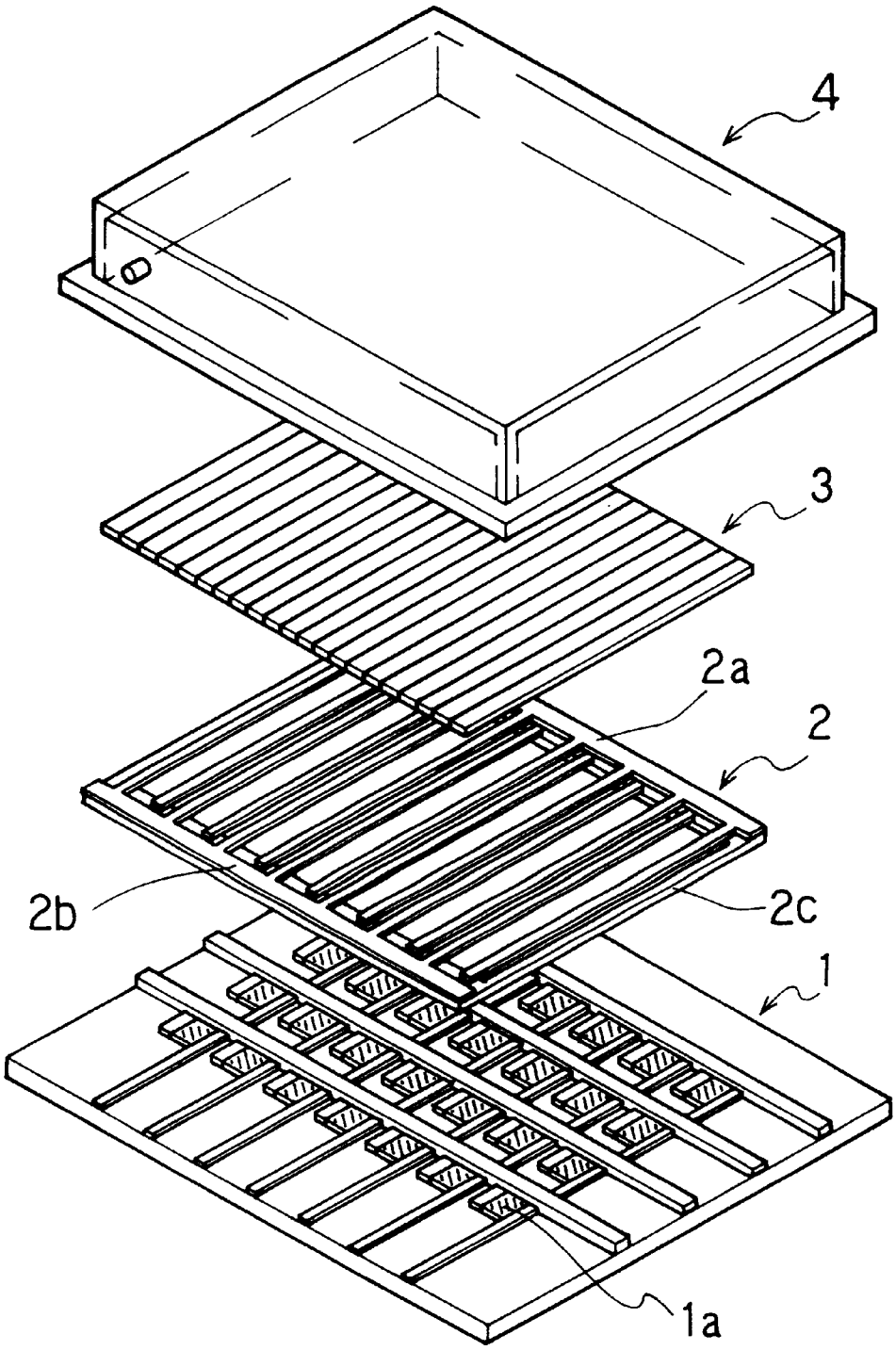
FIG. 1 is a perspective exploded view showing a display in the first embodiment of this invention.

FIG. 1 is a perspective exploded view showing a display in the first embodiment of this invention. As shown in FIG. 1, a display in the first embodiment of this invention comprises an electron emission source 1, electrodes 2, a fluorescent layer 3 and a vacuum container 4. The electron emission source 1 comprises a plurality of electron sources 1*a* which are arranged in a matrix, the electrodes 2 have a function for deflecting and focusing electron beams emitted from the electron emission source 1. The fluorescent layer 3 is excited by electron beams to emit a light. The vacuum container 4 contains the electron emission source 1, the electrodes 2 and the fluorescent layer 3 and the inside of the vacuum container 4 keeps under vacuum. The electrodes 2 are arranged between the electron emission source 1 and the fluorescent layer 3. The fluorescent layer 3 is provided at a position that contacts with the inner surface of the vacuum container 4. The part of the vacuum container 4 that contacts with the fluorescent layer 3 is made of transparent material in order to observe a light emitted by the fluorescent layer 3 from the outside. The inside of the vacuum container 4 has a degree of vacuum in a range between $10^{-6}$ and $10^{-8}$ torr.

Any type of an electron emission source 1 can be used as long as it can emit electron beams in a matrix. For example, an electron emission source, which is composed of a surface conductive element composed of a thin film of $SnO_2$(Sb) or a thin film of Au and the like or a thin film of other material, a microchip type electric field electron emission element such as Spindt type (microchip cathode of field emission type invented by Spindt), an electric field electron emission element having the MIM type structure or the similar structure or a cold cathode ray element composed of an electron emission material which is carbon material such as diamond, graphite, DLC (Diamond like Carbon) and the like, may be used.

An electrode 2 includes a first interdigital electrode 2*a*, a second interdigital electrode 2*b* and an insulating substrate 2*c*. The first interdigital electrodes 2*a* and the second interdigital electrodes 2*b* are arranged so that the components of the first interdigital electrode 2*a* and those of the second interdigital electrode 2*b* (interdigital part) engage each other with an appropriate distance between the electrode components on the insulating substrate 2*c*. According to the above-mentioned structure, a plurality of sets of a pair of interdigital electrodes 2*a* and 2*b* whose each interdigital part has a predetermined distance each other are arranged at a constant distance each other on the same flat surface of the insulating substrate 2*c*. The insulating substrate 2*c* is formed to a configuration that can maintain the first interdigital electrode 2*a* and the second interdigital electrode 2*b*, and electron beams can scan between each pair of electrodes positioned on the insulating substrate 2*c*. A shape of the insulating substrate 2*c* is for example, a shape whose center part is vacant and which has only four edges. The electron emission source 1, the electrodes 2 and the fluorescent layer 3 are constituted such that electron beams which are emitted in a matrix from the electron emission source 1 pass between a pair of electrodes consisting of the first interdigital electrode 2*a* and the second interdigital electrode 2*b*, and lands on the fluorescent layer 3.

A fluorescent layer 3 comprises a substrate such as a glass substrate on which is coated a fluorescent substance which is illuminated by irradiating with electron beams emitted from an electron emission source 1. In coating a fluorescent substance on a glass substrate, in order to provide a fluorescent layer 3 which can display a colored image, the fluorescent substance is coated in numerous stripes on the glass substrate in order of red (R), green (G) and blue (B). The stripe-arranged fluorescent substance can be provided by a method for printing directly on a glass substrate such as a screen-stencil or a method for transferring a material, which is printed on the resin sheet beforehand, to a glass substrate by applying heat or pressure. In addition to that, the stripe-arranged fluorescent substance can be provided by photolithography, for example, in the case of providing a cathode ray tube.

A vacuum container 4 is made of transparent material such as glass. This is because it is required that light emitted from a fluorescent layer 3 to be observed from outside of the vacuum container 4 so that the vacuum container 4 functions as a display. However, it is not required that the whole surface of the vacuum container 4 be transparent, but only the part of the vacuum container 4 which contacts with the fluorescent layer 3 is transparent (In FIG. 1, the upper area with largest surface).

In this embodiment, a case in which a fluorescent layer 3 and a vacuum container 4 are provided separately and are assembled to compose a display was explained. According to the structure, there is a merit that the design of the pressure proof display (a vacuum container 4) can be performed without regard to the shape of the fluorescent layer 3.

According to the display of this embodiment, it is preferable that an area of an electron emission source 1 where electron sources 1*a* are formed and an area of a fluorescent layer 3 are almost the same size and face each other completely to control electron beams. That is, it is preferable that the surface of the electron emission source 1 and the surface of the fluorescent layer 3 are parallel. However, when a size of display becomes large to some extent, it becomes important to perform the pressure proof design, as it is required to maintain a vacuum for the inside of the display. Consequently, it is required to curve a corner of the vacuum container or the whole surface of an image display area. In that case, it is very difficult to coat a fluorescent substance to form a fluorescent layer on the image display area of the vacuum container. In addition to that, it is also very difficult to make the area of the electron emission source where electron sources are formed and the fluorescent layer the same size and parallel. That is, a display having higher accuracy can be provided more easily by providing a fluorescent layer and a vacuum container separately than by providing a fluorescent layer on the inner surface of the vacuum container directly.

According to this embodiment, as above-mentioned, a fluorescent layer 3 and a vacuum container 4 are provided separately and assembled to compose a display. According to that, a vacuum container 4 can be designed easily. However, this invention is not limited to this structure. When a comparatively small display is composed, in order to simplify the manufacturing process and decrease the number of steps, a fluorescent substance may be coated on the inner surface of the vacuum container 4 (the inside which is kept under vacuum), that is, the vacuum container 4 and the fluorescent layer may be integrally formed. Then, a display may be composed by using the vacuum container having the fluorescent layer inside. When a comparatively small display is composed, it may not be required to curve a corner of a vacuum container, in this case, a fluorescent substance can be applied directly to the inner surface of a vacuum container accurately. Substantially, a fluorescent layer, whose area ratio to the size of an area of an electron emission source where electron sources are formed is 1:1 and which faces completely the area of an electron emission source where an electron source is formed, can be provided.

The electron emission source 1, the electrodes 2, the fluorescent layer 3 and the vacuum container 4 are thin and flat material. A display of this embodiment comprises the electron emission source 1, the electrodes 2 and the fluorescent layer 3 which are layered and contained in the vacuum container 4. Accordingly, a display of this embodiment can be thin and have a flat screen.

Figure 2:
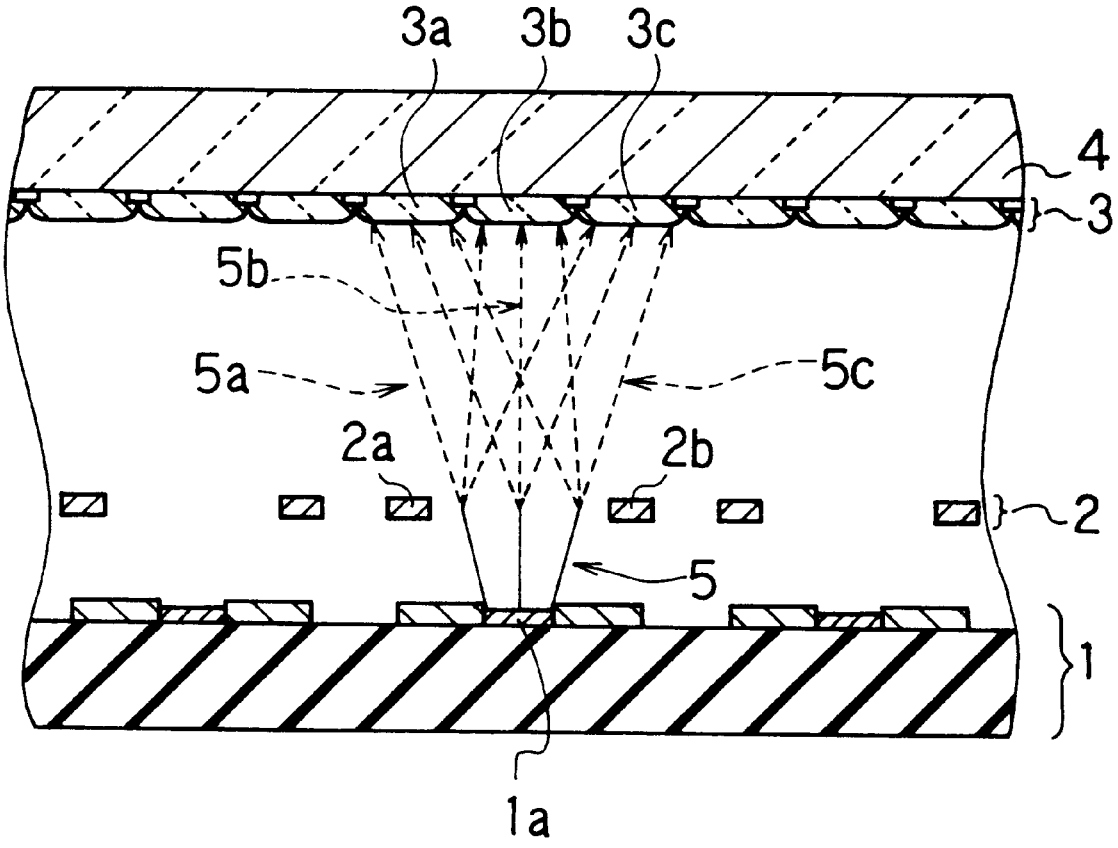
FIG. 2 is a cross-sectional view showing the schematic structure of a display in the first embodiment of this invention shown in FIG. 1.

FIG. 2 is a cross-sectional view showing the schematic structure of a display shown in FIG. 1. As shown in FIG. 2, electron beams are emitted appropriately from each electron source 1*a* which composes an electron emission source 1. Electrodes 2 are provided between an electron emission source 1 and a fluorescent layer 3 such that each electron beam which is emitted from each electron source 1*a* passes between a pair of electrodes which constitute the electrodes 2. Hereinafter, an action and an effect of a display of this embodiment will be explained by illustrating an action of electron beams 5 which are emitted from an electron source 1*a*.

Electron beams 5 emitted from an electron source 1*a* to pass between a pair of electrodes 2*a*, 2*b* which constitute electrodes 2, and are deflected by a potential of the electrode 2*a* and that of the electrode 2*b* to any direction of an electron beam 5*a*, 5*b* or 5*c*. Then, the electron beams 5 land on any component 3*a*, 3*b* or 3*c* which constitutes a fluorescent layer 3. The pair of electrodes 2*a*, 2*b* are provided to sandwich the electron beams 5 in the horizontal direction. The electron beams 5 are deflected to three grades in the horizontal direction by the potential of the electrode 2*a* and that of the electrode 2*b*.

Figure 3:
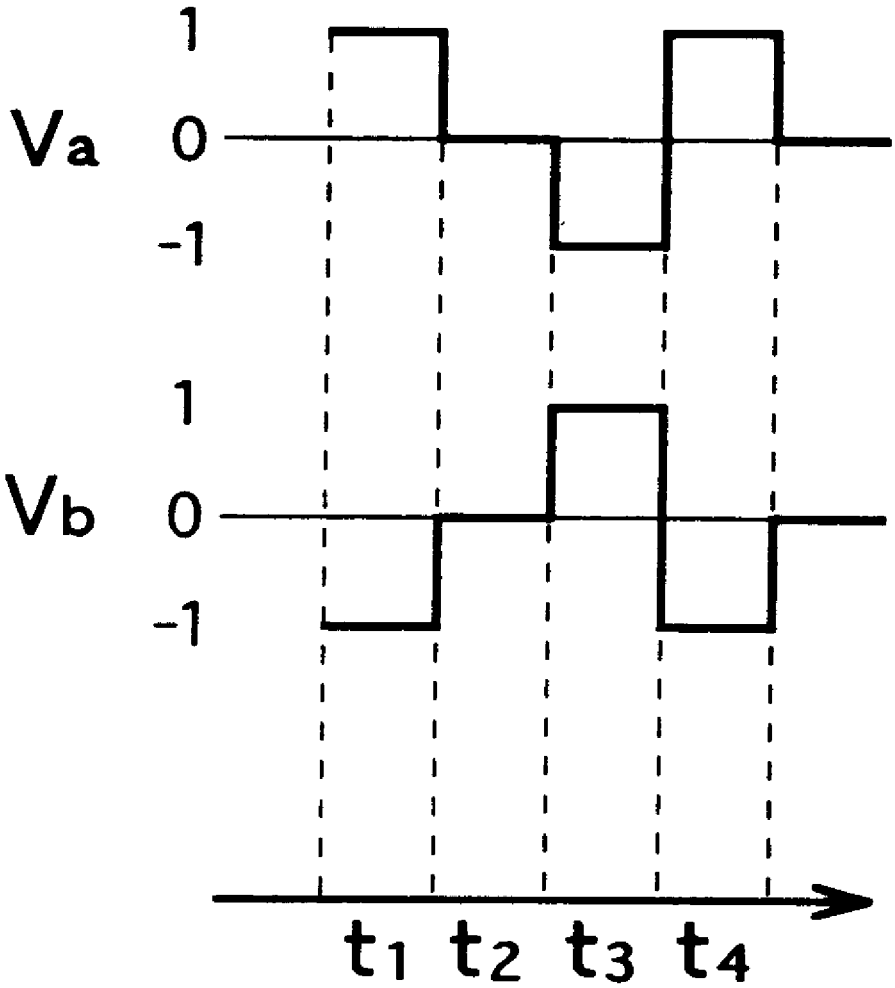
FIG. 3 is a figure showing a wave-form of voltage applied to an electrode in deflecting an electron beam shown in FIG. 2.

FIG. 3 is a figure showing a wave-form of voltage applied to electrodes 2*a* and 2*b* in deflecting electron beams 5. In FIG. 3, the horizontal axis shows time and the vertical axis shows a voltage. FIG. 3 shows a voltage Va which is applied to an electrode 2*a* for a predetermined period and a voltage Vb which is applied to an electrode 2*b* for a predetermined period. A voltage 0 is a reference voltage, a voltage 1 is a voltage which is higher than the reference voltage by a predetermined value of voltage. A voltage−1 is a voltage which is lower than the reference voltage by a predetermined value of voltage. Here, the reference voltage is a required potential to focus electrons emitted from an electron emission source 1 on the surface of a fluorescent layer 3 properly. The reference voltage is determined appropriately based on the voltage value applied to the electron emission source 1 and the fluorescent layer 3, the position, a configuration, distance of the electrode 2 and the like.

When the time is $T_1$, a voltage, Va=1, is applied to an electrode 2*a*, and a voltage, Vb=−1, is applied to an electrode 2*b*. That is, the predetermined value of Va, (Va=1), is applied to the electrode 2*a*, and the predetermined value, which is the same amount of that applied to the electrode 2*a* but whose sign is different, (Vb=−1), is applied to the electrode 2*b*. Consequently, when the time is $T_1$, a potential of the electrode 2*a* is higher than that of the electrode 2*b*, and the electron beams 5 are deflected to the direction of electron beams 5*a*. As a result, the electron beams 5*a* land on the component 3*a* of a fluorescent layer.

When the time is $T_2$, a voltage, Va=0, is applied to an electrode 2*a*, and a voltage, Vb=0, is applied to an electrode 2*b*. That is, the predetermined value of voltage is applied to both of electrodes 2*a* and 2*b*(Va=Vb=0). Consequently, when the time is $T_2$, a potential of the electrode 2*a* is same as that of 2*b*, and the electron beams 5 pass straight, in the direction of electron beams 5*b*. As a result, the electron beams 5*b* land on the component 3*b* of a fluorescent layer.

When the time is $T_3$, a voltage, Va=−1, is applied to an electrode 2*a*, and a voltage, Vb=1, is applied to an electrode 2*b*. That is, the predetermined value of Va a=−1) is applied to the electrode 2*a*, and the predetermined value, which is the same amount of that applied to the electrode 2*a* but whose sign is different, (Vb=1), is applied to the electrode 2*b*. Consequently, when the time is $T_3$, a potential of the electrode 2*b* is higher than that of the electrode 2*a*, and the electron beams 5 are deflected to the direction of electron beams 5*c*. As a result, the electron beams 5*c* land on the component 3*c* of a fluorescent layer.

As above-mentioned, in this embodiment, an electron beam 5 is deflected by applying a voltage which is shown in FIG. 3 to electrodes 2*a* and 2*b*. In applying a voltage to electrodes 2*a* and 2*b*, the sum of the voltage applied to electrodes 2*a* and 2*b* for a predetermined time is set to be the same. That is, a voltage applied to electrodes 2*a* and 2*b* is set as follows. When the time is $T_1$, the sum of voltage, (Va(1)+Vb(−1)), is 0. When the time is $T_2$, the sum of voltage, (Va(0)+Vb(0)), is 0. When the time is $T_3$, the sum of voltage, (Va(−1)+Vb(1)), is 0.

According to this embodiment, each voltage, Va and Vb, is set as above-mentioned, the sum of a potential of electrodes 2 can be kept at the same level for all the time, and in deflecting electron beams, there is not any fluctuation of potential. Consequently, a display that can provide a stable picture can be obtained.

As above-mentioned, electron beams 5 are deflected, in addition to that, the electron beams 5 are also focused when they land on a fluorescent layer 3. In this embodiment, in order to focus electron beams 5, an average electric field strength between an electron emission source 1 and a fluorescent layer 3 is controlled. Specifically, a potential that is applied to electrodes 2 is set so that the average electric field strength between a fluorescent layer 3 and electrodes 2 becomes stronger than that between electrodes 2 and an electron emission source 1. Accordingly, electron beams 5 which pass between a pair of electrodes can be deflected appropriately and focused to land on any component 3*a*, 3*b* or 3*c* of a fluorescent layer while being focused.

Further, as above-mentioned, electron beams can be focused with high density on a fluorescent layer, even if the emission-site of electron beams is not uniform, which is often observed in a cold cathode ray element, for example, that is composed of carbon material. As a result, even if there is a variation in brightness distribution in a beam spot that causes deterioration of the displayed image, a display which can express an image which is not practically influenced by the variation in brightness in the beam spot can be obtained.

In this embodiment, a case in which three grades of voltage are applied to an electrode 2 to deflect electron beams 5 in the horizontal direction to three grades (refer to FIGS. 2 and 3) was explained. However, this invention is not limited thereto. For example, electron beams 5 may be deflected to more grades by applying more grades of potential (for example, applying four or more grades of voltage) between a pair of electrodes, 2*a* and 2*b*. As above-mentioned, the resolution of a display can be increased more, as the number of grades of deflection is increased more.

In this embodiment, a display, in which electron beams 5 were deflected in the horizontal direction (Longitudinal direction of display), was explained. However, this invention is not limited thereto. For example, a display in which electron beams 5 were deflected in the vertical direction may be used. In addition to that, a display in which electron beams 5 were deflected in both directions, that is, both the horizontal direction (Longitudinal direction of display) and the vertical direction may be used. In order to deflect electron beams 5 in the vertical direction, a pair of electrodes 2*a* and 2*b* which constitute electrodes 2 have to be arranged between an electron emission source 1 and a fluorescent layer 3, so that the pair of electrodes 2*a* and 2*b* sandwich electron beams 5 in the vertical direction. In order to deflect electron beams both in the horizontal and the vertical directions, in addition to the electrodes 2 explained in this embodiment, another electrode having the same structure as that of the electrodes 2 may be arranged between the electron emission source 1 and the fluorescent layer 3, so that a pair of electrodes which constitute another electrode sandwich electron beams in the vertical direction.

As explained-above, in a display of this embodiment, the electrodes 2 having a function for deflecting and focusing electron beams 5 are arranged between the electron emission source 1 and the fluorescent layer 3. According to the display of this embodiment, electron beams 5 can be focused and deflected by the electrodes 2. Consequently, electron beams 5*a*, 5*b* and 5*c* can be landed at a desired component of a fluorescent layer, 3*a*, 3*b* or 3*c*, respectively. Therefore, according to this embodiment, overlap irradiation, that is, irradiation of an electron beam on a plurality of components of fluorescent substance at the same time, can be prevented by focusing the electron beams 5. Furthermore, electron beams can be landed at components of fluorescent layer, whose array pitch is finer than that of an electron emission source 1 (that is, a component of fluorescent substance having more arrays than the number of arrays of an electron source 1*a*) by deflecting electron beams 5 appropriately. As a result, a display having high resolution can be provided.

In this embodiment, as shown in FIG. 2, a case in which electron beams 5*b* which are emitted from an electron source 1*a* passes substantially through the midpoint of the line connecting a pair of electrodes 2*a* and 2*b*, and lands on a component 3*b* of a fluorescent layer exactly, was explained. That is, a case of a display, in which the position of an electron emission source 1, electrodes 2 and a fluorescent layer 3 are aligned accurately, was explained. However, in preparing a display, the deviation of landing position of electron beams 5 on the fluorescent layer 3 is caused by manufacturing error or assembling error of each part. Needless to say, careful attention was paid to design and manufacture of a display, however, it is very difficult to eliminate the deviation of landing position of electron beams caused by manufacturing error or the assembling error completely. When the deviation of landing position of electron beams 5 is generated, the possibility of occurrence of overlap irradiation or error irradiation may be increased, image quality of display may be deteriorated, and as a result, it becomes very difficult to provide a display having high resolution.

In a display of this embodiment, a deviated position memory and a correction system are provided. The deviated position memory stores data of deviation of landing position of electron beams 5 on a fluorescent layer 3. The correction system applies an off-set voltage between a pair of electrodes 2*a* and 2*b* to correct the deviation of landing positions of electron beams based on the stored data. According to the display, even if the deviation of landing position of electron beams 5 on a fluorescent layer 3 is generated by assembling error in assembling a display, the deviation can be corrected by applying an off-set voltage to electrodes 2. Consequently, overlap irradiation caused by the deviation of landing position of electron beams 5 can be prevented. As a result, a display having high resolution can be provided.

A Second Embodiment

Figure 4:
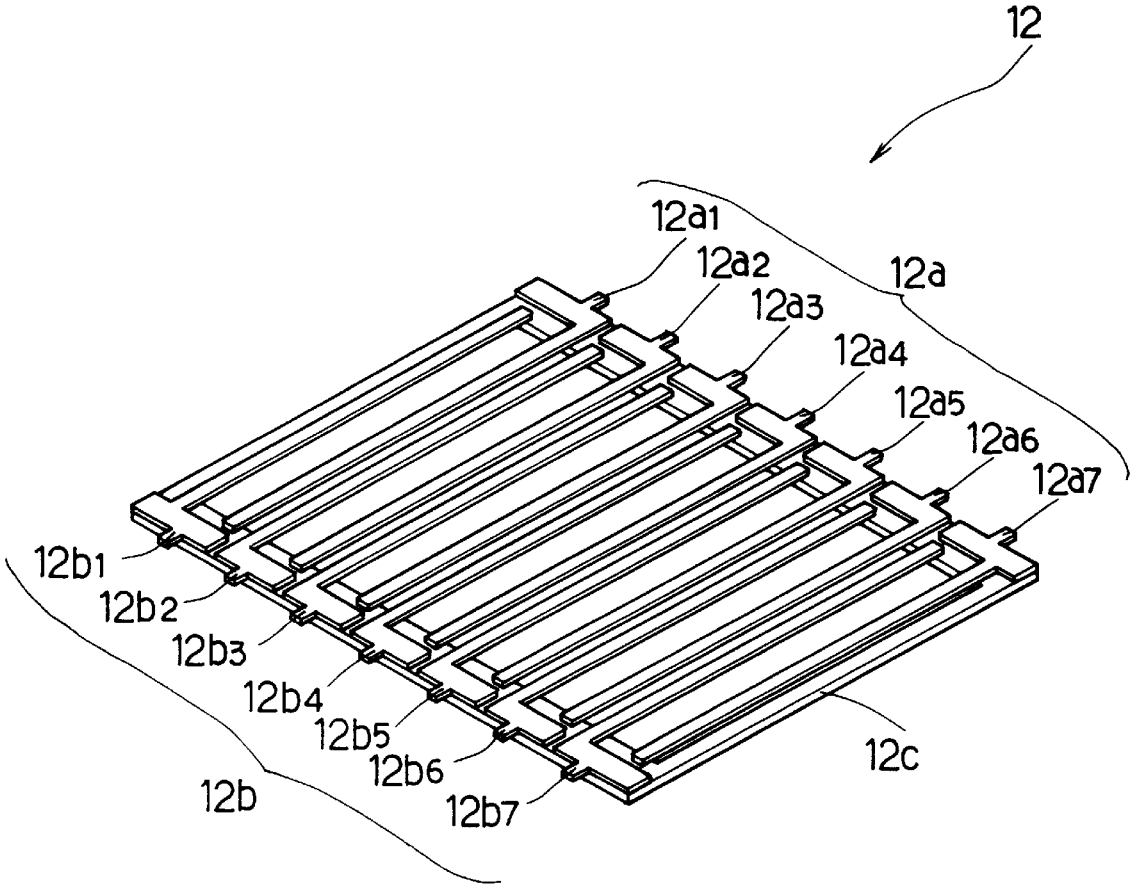
FIG. 4 is a perspective view showing electrodes of the display in the second embodiment of this invention.

FIG. 4 is a perspective exploded view showing electrodes 12 which compose a display in the second embodiment of this invention. Basically, the structure of a display of the embodiment is same as that of a first embodiment (refer to FIGS. 1 and 2). Only the structure of the electrodes 12 and the periphery such as the structure of an electrode, wiring of an electrode, and control of an electrode and the like are different from those of a display of a first embodiment.

As shown in FIG. 4, an electrode 12 includes a first interdigital electrode 12*a*, a second interdigital electrode 12*b* and an insulating substrate 12*c*. The first interdigital electrode 12*a* includes a first interdigital electrode component, $\mathbf{12}a_1$–$\mathbf{12}a_7$. The second interdigital electrode 12*b* includes a second interdigital electrode component, $\mathbf{12}b_1$–$\mathbf{12}b_7$. That is, the first interdigital electrode 12*a* and the second interdigital electrode 12*b* of the embodiment are divided into a plurality of components so that each component is part of a pair of electrodes that sandwiches each electron beam. And all electrodes are provided independently. In addition to that, in the display of this embodiment, different potentials can be applied independently to each component $\mathbf{12}a_1$–$\mathbf{12}a_7$ of the interdigital electrode 12*a* and each component $\mathbf{12}b_1$–$\mathbf{12}b_7$ of the second interdigital electrode 12*b*.

According to a display of this embodiment, electrodes 12 have the above-mentioned structure, and therefore different potentials can be applied to electron beams emitted from an electron emission source. That is, electrodes 12 are divided into pairs of electrodes corresponding to electron beams, and a voltage can be applied independently to each divided electrode.

According to this embodiment, even if there is variation of the deviation amount of landing position of electron beams caused by assembling error, or the like, an optimum off-set voltage can be applied independently to electron beams, respectively, as the pairs of electrodes are divided corresponding to the electron beams. As a result, the deviation of landing position of electron beams can be corrected independently and effectively.

In the above-mentioned embodiment, a case in which electrodes are divided into pairs of electrodes which sandwich each electron beam, was explained. However, this invention is not limited thereto. For example, a plurality of electron beams can be used as one block and electrodes can be divided and used corresponding to this block. According to a display that includes the above-mentioned electrode, an off-set voltage can be applied to each block, the landing position of electron beams in every predetermined-area of a display can be corrected. As a result, the quality of the whole surface of the display can be improved by a comparatively a simple correction system.

A Third Embodiment

Figure 5:
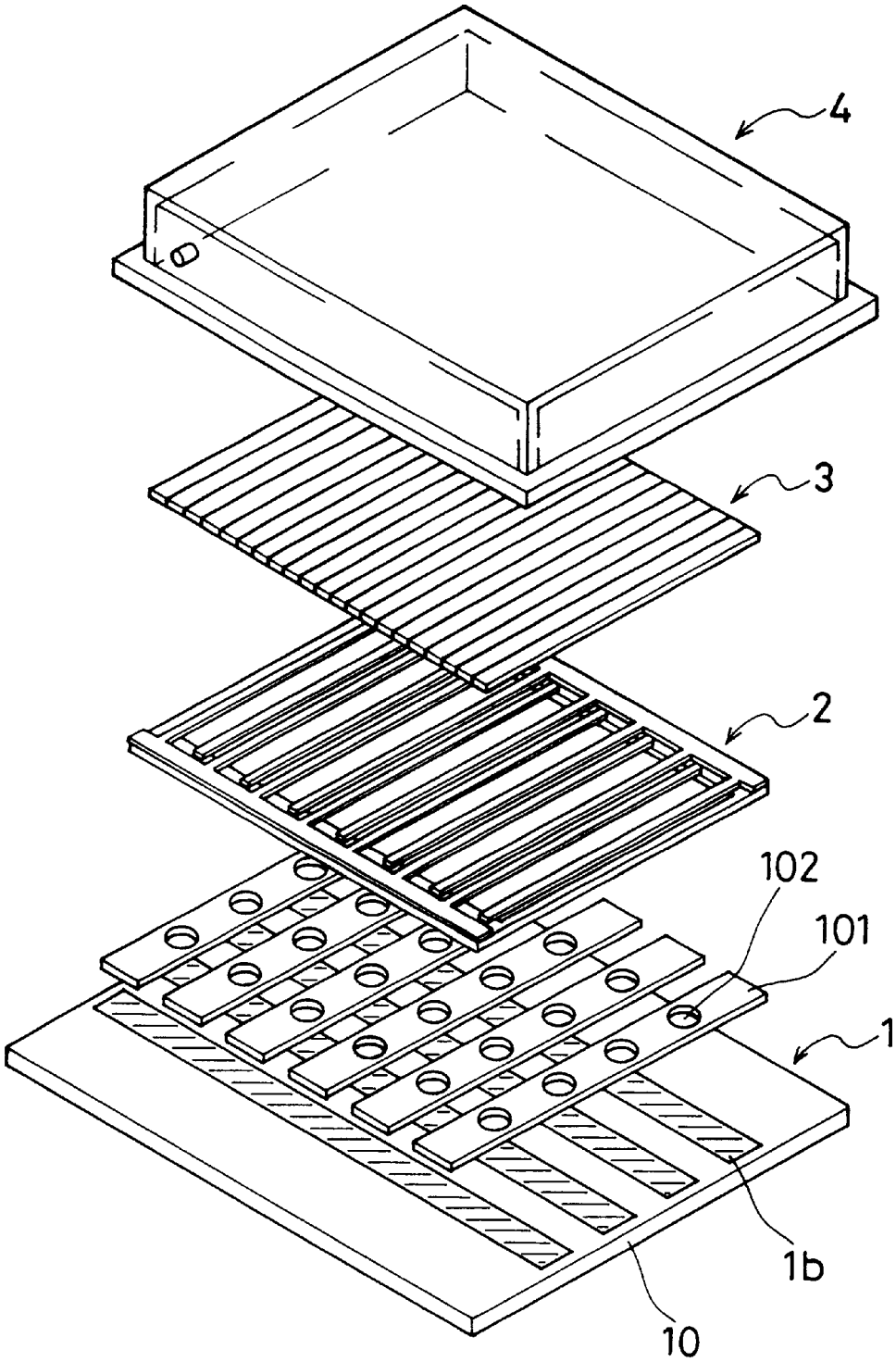
FIG. 5 is a perspective exploded view showing a display in the third embodiment of this invention.

FIG. 5 is a perspective exploded view showing a display in a third embodiment of this invention. Basically, a display of this embodiment has the same structure as that of the first embodiment (refer to FIG. 1). However, the structure of the electron emission source is different. That is, as shown in FIG. 5, control electrodes 101 are provided additionally, and the patterned geometry of an electron source 1*b* on a substrate 10 is changed from that of the first embodiment (FIG. 1).

Control electrodes 101 are divided electrically and arranged in stripes, and a hole 102 is provided at the position where a predetermined electron beam passes through so that electrons can pass through the hole 102. In the same way, the electron sources 1*b* formed on the substrate 10 are patterned in stripes in the direction which is perpendicular to the divide direction of the control electrodes 101 and the electron sources are separated electrically. Further, when electrons are not emitted, the potential difference of the potential of the control electrodes 101 from the potential of the stripe-arranged electron source 1*b* is negative or the potential difference between the potential of the control electrode 101 and the potential of the strip-arranged electron source 1*b* is very low.

When the potential of some control electrodes 101 is selected to be positive, and the potential of some stripe-arranged electron sources 1*b* is selected be negative, only the potential difference of the cross section of the selected control electrode and the selected stripe-arranged electron sources becomes large, and electrons are emitted from the cross section of the electron source 1*b*(attraction of electron). Electrons emitted from the selected cross section pass through a hole 102 provided on a control electrode 101(selective transmission) in the direction of a fluorescent layer 3. After that the electrons pass in the same way as those of the first embodiment, and therefore the explanation will be omitted.

According to the display having the above-mentioned structure and function of this embodiment, even if electron sources are not provided in a matrix on essentially the same surface, the electron sources can be used as an electron source which can emit electron beams in a matrix by providing control electrodes 101 additionally. That is, the combination of the control electrodes 101 having the above-mentioned structure and the electron sources 1*b* can be considered as an electron emission source having electron sources arranged in a matrix.

Further, in the above-mentioned embodiment, a case in which control electrodes 101 are provided on one surface was explained. However, a function of attracting electrons due to the potential difference and a function of selective transmission may be achieved by more than two electrodes, for example, a plurality of electrodes may be provided in the direction in which electrons are emitted from electron sources. According to the above-mentioned structure, the same effect can be obtained.

A Fourth Embodiment

Figure 6:
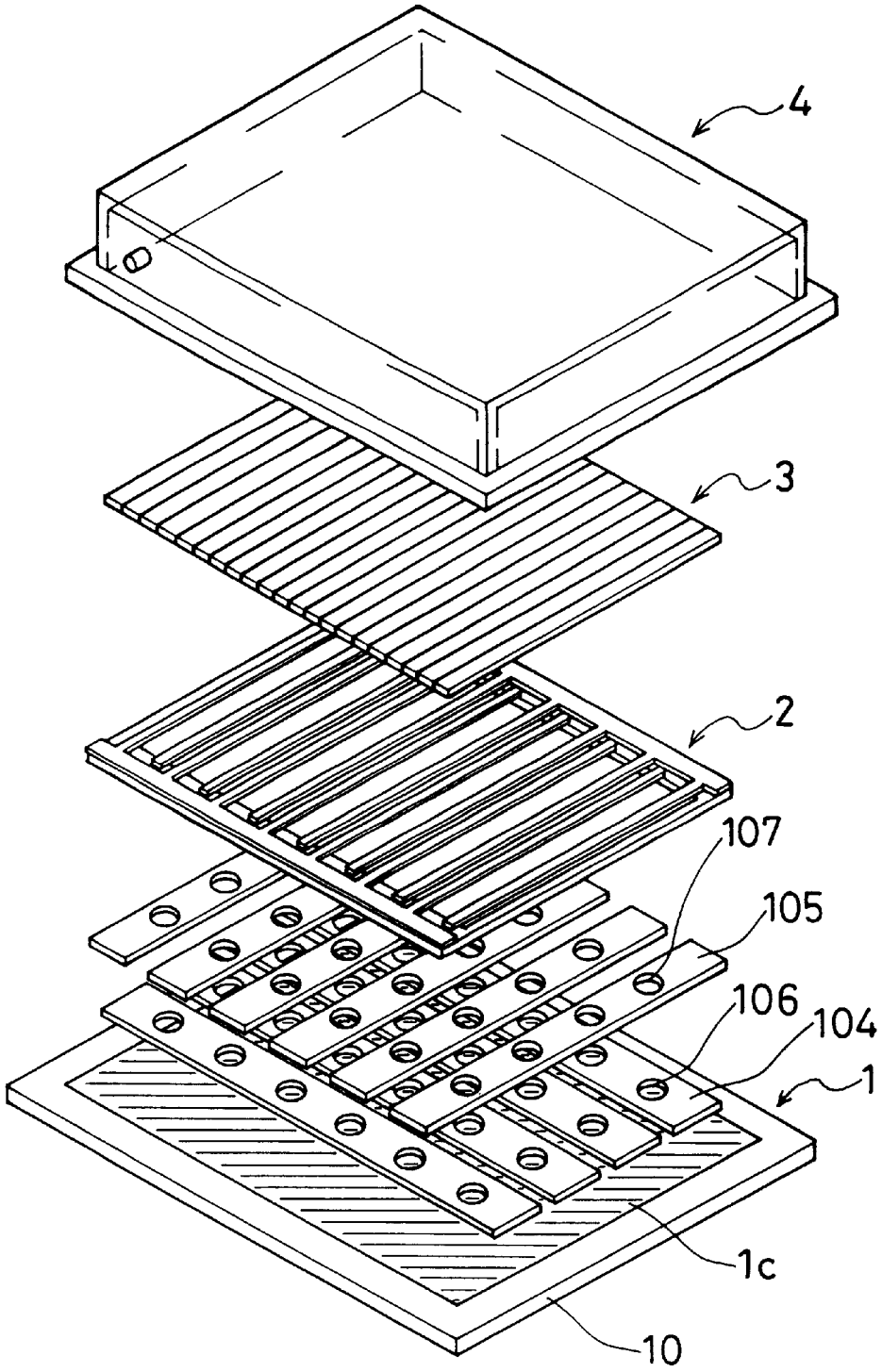
FIG. 6 is a perspective exploded view showing a display in the fourth embodiment of this invention.
Figure 7:
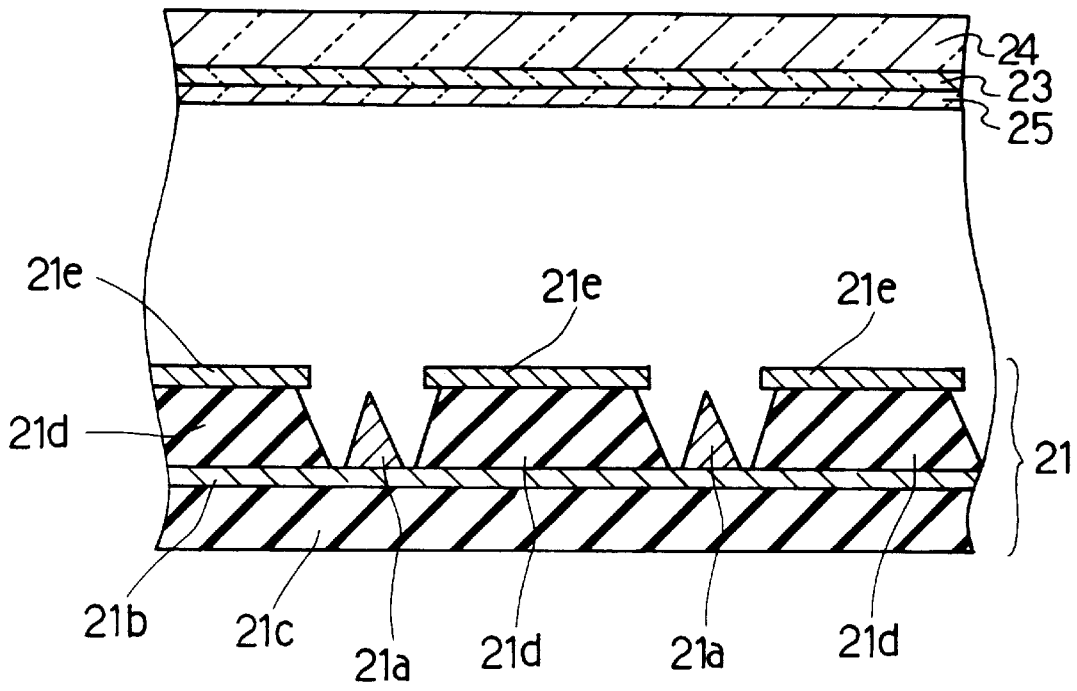
FIG. 7 PRIOR ART
FIG. 7 is a cross-sectional view showing the schematic structure of a first conventional display.
Figure 8:
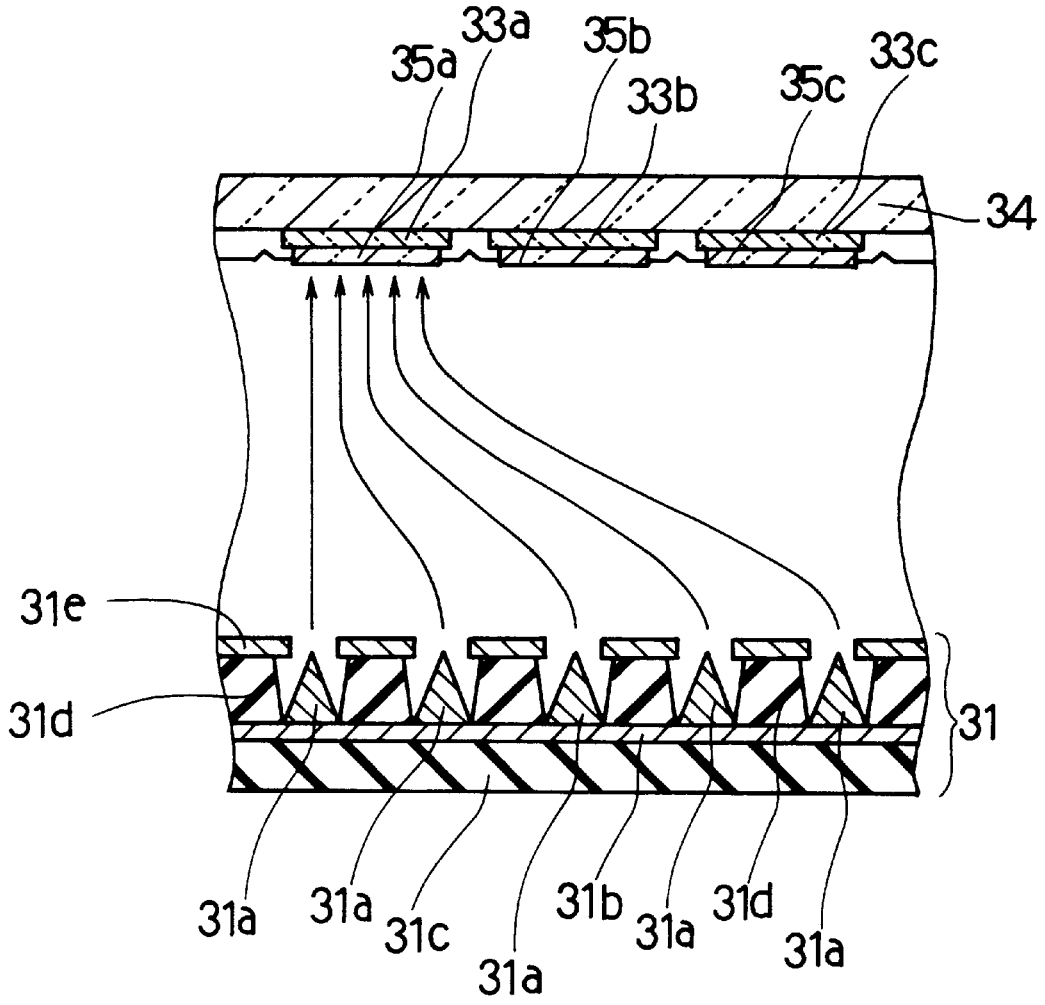
FIG. 8 PRIOR ART
FIG. 8 is a cross-sectional view showing the schematic structure of a second conventional display.
Figure 9:
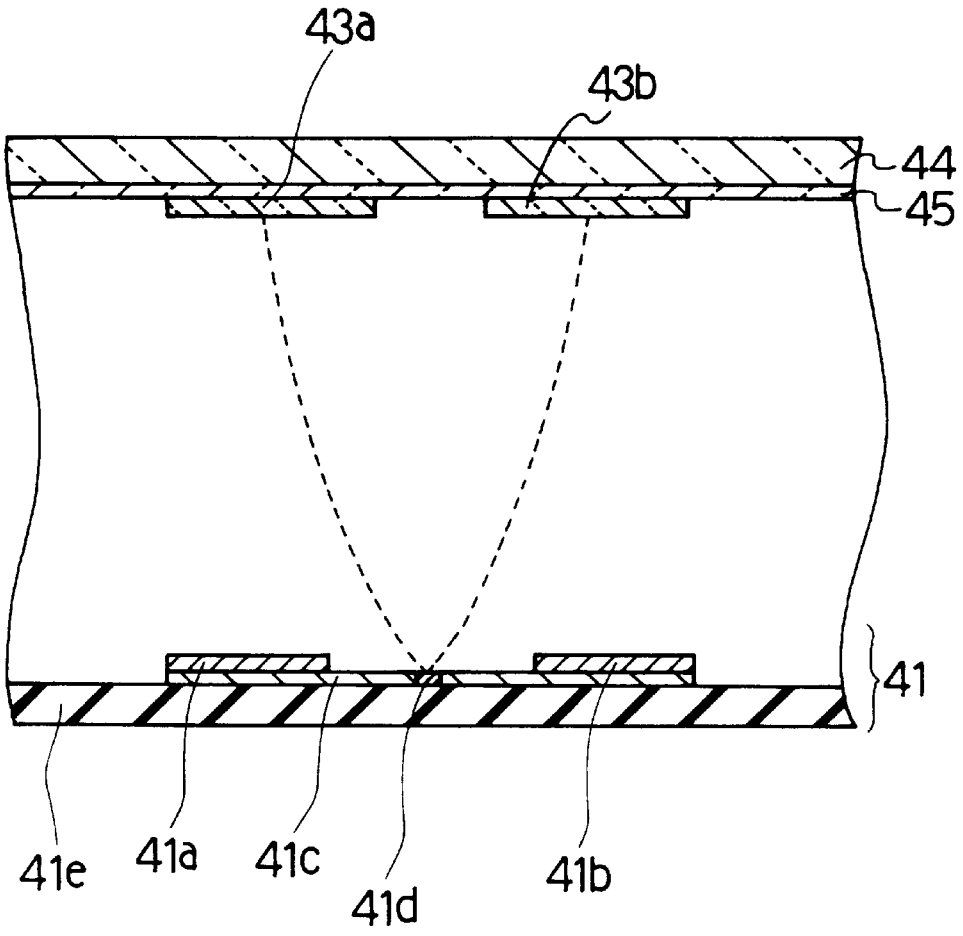
FIG. 9 PRIOR ART
FIG. 9 is a cross-sectional view showing the schematic structure of a third conventional display.

FIG. 6 is a perspective exploded view showing a display in a fourth embodiment of this invention. Basically, a display of this embodiment has the same structure as that of the first embodiment (refer to FIG. 1). However, the structure of the electron emission source is different. That is, as shown in FIG. 6, electron sources 1*c* are arranged continuously over the surface of the substrate and a plurality of electrodes, 104 and 105 are provided to emit electrons from electron sources 1*c*.

As shown in FIG. 6, control electrodes 104 are divided electrically and arranged in stripes, and a hole 106 is provided on the control electrode 104 at the position where a predetermined electron beam passes through so that electrons can pass through the hole 106. In the same way, control electrodes 105 are divided electrically and arranged in stripes, and a hole 107 is provided on the control electrode 105 at the position corresponding to the hole 106. Consequently, electrons which pass through the hole 106 can pass through the hole 107. The control electrodes 104 and 105 are arranged to cross at right angles. Electron sources 1*c* are arranged continuously over the surface of the substrate 10. Further, when electrons are not emitted, the potential difference of the potential of the control electrodes 104 from the potential of the plane-formed electron source 1*c* is negative or the potential difference between the potential of the control electrodes 104 and the potential of the plane-formed electron source 1*c* is very low.

When the potential of some control electrodes 104 is selected to be positive, only the potential difference of the stripe part of the selected control electrode 104 becomes large, and electrons are emitted from the part (attraction of electron). Electrons emitted from the selected stripe part pass through all holes 106 provided on the control electrode 104. Next, when the potential of some control electrodes 105 is selected to be positive, and the potential of other control electrodes 105 is selected to be a cutoff potential, only the electron passing through a cross section of the selected control electrodes 104 and 105, of all electrons which pass through a hole 106, passes through a hole 107 provided on the control electrode 105 (selective transmission) in the direction of the fluorescent layer 3. After that the electrons pass in the same way as those of the first embodiment, and therefore the explanation will be omitted.

According to the display having the above-mentioned structure and function of this embodiment, even if electron sources 1*c* are arranged continuously over the surface of the substrate, the electron sources can be used as an electron source which can emit electron beam in a matrix by providing two sets of control electrodes 104 and 105. That is, the combination of the control electrodes 104 and 105 having the above-mentioned structure and the electron source 1*c* can be considered as an electron emission source having electron sources arranged in a matrix.

Further, in the above-mentioned embodiment, a case in which two sets of control electrodes are provided was explained. However, an electrode having a function of attracting electrons due to the potential difference may be provided additionally and a function of selective transmission may be achieved by two sets of control electrodes. That is, more than three sets of electrodes may be provided. According to the above-mentioned structure, the same effect can be obtained.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An image display apparatus comprising:

a vacuum container whose inside is kept under vacuum;

a fluorescent layer;

an electron emission source having an electron source;

and electrodes having a function to focus and deflect for scanning electron beams emitted from said electron emission source;

wherein said fluorescent layer, said electron emission source and said electrodes are enclosed within said vacuum container, and said electrodes are arranged between said fluorescent layer and said electron emission source, the average electric field strength between said fluorescent layer and said electrodes is set to be stronger than that between said electrodes and said electron emission source, and said fluorescent layer is illuminated by said electron beams.

2. The image display apparatus according to claim 1, wherein said electrodes are pairs of electrodes that sandwich electron beam trajectories and different voltages can be applied between said pairs of electrodes.

3. The image display apparatus according to claim 2, further comprising deviated position memory for storing data corresponding to a deviation of landing position of said electron beams on said fluorescent layer, and a correction system for applying an off-set voltage between said pairs of electrodes to correct the deviation of the landing position of said electron beams based on said data.

4. The image display apparatus according to claim 3, wherein the same off-set voltage is applied to all of said pairs of electrodes of the image display apparatus.

5. The image display apparatus according to claim 3, wherein the landing position of each electron beam can be corrected independently by applying said off-set voltage to each of said pairs of electrodes independently.

6. The image display apparatus according to claim 3, wherein said pairs of electrodes of the image display apparatus are divided into a plurality of blocks, and landing positions of the electron beams can be corrected independently for each block of the pairs of electrodes by applying said off-set voltage to each of said blocks of the pairs of electrodes.

7. The image display apparatus as claimed in claim 1, wherein said electrodes comprise a first electrode which focuses and deflects said electron beams in the horizontal direction and a second electrode which focuses and deflects said electron beams in the vertical direction.

8. The image display apparatus as claimed in claim 1, wherein said fluorescent layer is formed on an inner surface of said vacuum container.

9. The image display apparatus as claimed in claim 1, wherein said electron source is divided and arranged in a matrix.

10. The image display apparatus as claimed in claim 1, wherein said electron source is divided and arranged in stripes.

11. The image display apparatus as claimed in claim 1, wherein said electron source is arranged continuously over a surface of a substrate.

* * * * *